US007105739B2

(12) United States Patent
Abe

(10) Patent No.: US 7,105,739 B2
(45) Date of Patent: Sep. 12, 2006

(54) COAXIAL CABLE

(75) Inventor: Chiaki Abe, Tokyo (JP)

(73) Assignee: Yosho Co., Ltd., Tokyo (JP)

( * ) Notice: Subject to any disclaimer, the term of this patent is extended or adjusted under 35 U.S.C. 154(b) by 0 days.

(21) Appl. No.: 10/918,384

(22) Filed: Aug. 16, 2004

(65) Prior Publication Data

US 2006/0032658 A1 Feb. 16, 2006

(51) Int. Cl.
*H01B 7/00* (2006.01)
*H01B 7/18* (2006.01)

(52) U.S. Cl. ..... 174/28; 174/102 R; 174/105 B

(58) Field of Classification Search ..... 174/102 R, 174/105 R, 106 R, 108, 109, 36, 105 B, 174/28; 333/12, 243–244
See application file for complete search history.

(56) References Cited

U.S. PATENT DOCUMENTS 3,975,700 A * 8/1976 Halstead ..... 333/237
4,376,920 A * 3/1983 Smith ..... 333/12
4,987,394 A * 1/1991 Harman et al. ..... 333/237
5,150,442 A * 9/1992 Desmons ..... 385/101
5,159,276 A * 10/1992 Reddy, III ..... 324/678
5,557,698 A * 9/1996 Gareis et al. ..... 385/101
6,384,337 B1 * 5/2002 Drum ..... 174/102 R

FOREIGN PATENT DOCUMENTS

JP 3024770 3/1996

* cited by examiner

*Primary Examiner*—William H. Mayo, III
(74) *Attorney, Agent, or Firm*—Wenderoth, Lind & Ponack, L.L.P.

(57) ABSTRACT

A first conductor is provided on an outer circumference of a central conductor with an insulator therebetween, a second conductor is provided on a concentric circle having the central conductor as its center and outside the first conductor with an insulator therebetween. A coaxial cable is formed by coating the outside of the second conductor, which is on the concentric circle having the central conductor as its center, with an insulating external coating. A DC voltage source is able to apply DC voltage having a predetermined voltage value between the first conductor and the second conductor such that the direct current flowing in the first conductor and the second conductor takes a desired value. A noise barrier zone formed by the electro-magnetic action of the desired current is formed in the part surrounded by the first conductor and the second conductor on the outer circumference of the central conductor.

8 Claims, 7 Drawing Sheets

COAXIAL CABLE

BACKGROUND OF THE INVENTION

1. Field of the Invention

The present invention relates to a coaxial cable, and more particularly relates to a coaxial cable in which a central conductor is used for transmitting images. A first conductor and a second conductor, which is outside the first conductor, are provided on the circumference of concentric circles having the central conductor as their center.

2. Description of Related Art

For transmitting images, coaxial cables having characteristic impedance of 75 Ω (ohms) are generally employed. It is known that the attenuation of picture signals is phenomenally approximated by, roughly, one-half power of the frequency. The disclosed measured values, for example, in a 3C-2V coaxial cable: when the frequency of the picture signal is 4 MHz, the attenuation is 27 dB/Km; when the frequency of the picture signal is 6 MHz, the attenuation is 32 dB/Km; when the frequency of the picture signal is 8 MHz, the attenuation is 38 dB/Km; and when the frequency of the picture signal is 10 MHz, the attenuation is 42 dB/Km. According to these measured values, it is understood that, generally, the higher the picture frequency, the larger the degree of the attenuation. Meanwhile, various factors other than the characteristic impedance of the coaxial cable are conceivable as the cause of the attenuation of picture signals. Among those factors, an external factor, other than noises, caused by the picture signal itself causes noises. Noises caused by such external factor are known to be a cause of the attenuation of picture signals and disturbance of picture signals. Herein, it is considered that the disturbance or the like of picture signals because of noises caused by such external factor is included in a broad sense of attenuation.

Meanwhile, cable compensators are employed in accordance with needs to compensate the attenuation of the picture signals. Cable compensators are amplification means of picture signals and essential means for providing images influenced by as little attenuation as possible, or for compensating for the attenuation. These compensators are disposed, in advance, at a predetermined distant interval in accordance with the attenuation state of the picture signals, and at every position, picture signals are amplified. In a case of a general coaxial cable, one cable compensator is disposed about every 100 m.

However, when cable compensators amplify attenuated picture signals, a phenomenon is caused in which noises are amplified at the same time. In the case of noises, the next cable compensator further amplifies the amplified noises that have been amplified by one cable compensator. Amplification is repeated one to the next, and as a result, the attenuation of the picture signal in a broad sense is accelerated. As described above, cable compensators have to be employed in order to compensate for the attenuation of picture signals. However, on the contrary, when cable compensators are overused, the result is that clear images cannot be obtained because of noises.

In relation to such coaxial cable, the inventor of the present application has formerly disclosed a coaxial cable comprising a first tubular electro-magnetic shielding conductor and a second tubular electro-magnetic shielding conductor for feeding current for driving devices. In this coaxial cable, the first tubular electro-magnetic shielding conductor is provided outside a central conductor with an insulator therebetween, the second tubular electro-magnetic conductor is provided outside the first tubular electro-magnetic shielding conductor with an insulator therebetween, the outer circumference of the second tubular electro-magnetic shielding conductor is coated with an external coating which is an insulator, and the first tubular electro-magnetic shielding conductor and the second tubular electro-magnetic shielding conductor are configured for feeding current for driving devices. According to this coaxial cable, for example, when electricity is allowed to flow with the inner first tubular electro-magnetic shielding conductor being negative and the outer second tubular electro-magnetic shielding conductor being positive, the magnetism in the center space becomes zero. Therefore, no magnetic disturbance is imposed on the central conductor, and magnetic actions caused in the cable form a barrier thereby carrying out protection against disturbing electric waves coming in from outside. Therefore, for example, the picture waveform sent from a monitoring camera is not disturbed at all, and the image of a monitor is not disturbed and clear images can be obtained.

[Prior Document]

Japanese utility model registration, publication No. 3024770 (FIG. 1)

However, there has been a problem for practical use regarding, among external noises, the influence of, for example, high frequency noises having steep wave forms generated when an accelerator of an electric system of an engine, for example, a motorcycle is suddenly stomped on. Also, in regard to image transmission, there has been a problem for practical use regarding how far a distance clear images having no attenuation can be transmitted without employing cable compensators.

The present invention has been developed to solve the above described problems. Its object is to provide a coaxial cable that is able to completely shut out external noises and transmit picture signals not influenced by noises over a long distance.

SUMMARY OF THE INVENTION

In order to accomplish the above described object, a first mode of the coaxial cable of the invention of the present application has a configuration in which a first conductor is provided on the outer circumference of a central conductor with an insulator therebetween; and a second conductor is provided on the concentric circle which has the central conductor as its center and outside the first conductor with an insulator therebetween. The outside of the second conductor is coated by an external coating which is an insulator; and a DC voltage source is able to apply DC voltage between the first conductor and the second conductor.

In order to accomplish the above described object, a second mode of the coaxial cable of the invention of the present application has a configuration in which a first conductor is provided on the outer circumference of a central conductor with an insulator therebetween; and a second conductor is provided on the concentric circle which has the central conductor as its center and outside the first conductor with an insulator therebetween. The outside of the second conductor is coated by an external coating which is an insulator; and a DC voltage source is able to apply DC voltage having a predetermined voltage value between the first conductor and the second conductor such that the direct current flowing in the first conductor and the second conductor takes a desired value. A noise barrier zone is formed in the area surrounded by the first conductor which is on the outer circumference of the central conductor and the second conductor, by electro-magnetic action brought about by the desired current.

In order to accomplish the above described object, a third mode of the coaxial cable of the invention of the present application has a configuration in which, in the first or the second modes, the first conductor and/or the second conductor is a braided conductor.

In order to accomplish the above described object, a fourth mode of the coaxial cable of the invention of the present application has a configuration in which, in any of the first to the third mode, the second conductor comprises a plurality of conductors provided on the outer circumference of the first conductor with the insulator therebetween.

In order to accomplish the above described object, a fifth mode of the coaxial cable of the invention of the present application has a configuration in which, in any of the first to the third modes, the second conductor comprises a conductor provided so as to be wound around the outer circumference of the first conductor with the insulator therebetween.

In order to accomplish the above described object, a sixth mode of the coaxial cable of the invention of the present application has a configuration in which, in any mode of the first to the fifth modes, the DC voltage having a predetermined power supply voltage value is applied such that the first conductor side has positive voltage and the second conductor side has negative voltage, or the first conductor side has negative voltage and the second conductor side has positive voltage. The direct current having the desired current value flows in the first conductor and the second conductor.

In order to accomplish the above described object, a seventh mode of the coaxial cable of the invention of the present application has a configuration in which, in any mode of the first to sixth modes, the power supply voltage value of the DC voltage source falls within 10 V to 150 V.

In the present invention, by virtue of the above described constitution, in the part surrounded by a first conductor which is on the concentric circle having a central conductor of the coaxial cable as its center and a second conductor which is outside of the first conductor, a noise barrier zone which is an electro-magnetically active field where the magnetic fields constantly cancel each other out is formed. The intrinsic noise shielding effect of the shield is added so as to produce an extremely strong noise shielding effect. Therefore, according to the coaxial cable of the present invention, external noises can be completely shut out, a cable compensator or the like for preventing attenuation of picture signals can be reduced, a simple system can be composed, and picture signals under no influence of noises can be transmitted over a long distance. In addition, considerable economic effects are brought about.

DETAILED DESCRIPTION OF THE PREFERABLE EMBODIMENTS

The embodiments of the present invention will next be explained based on the accompanying drawings.

Figure 1:
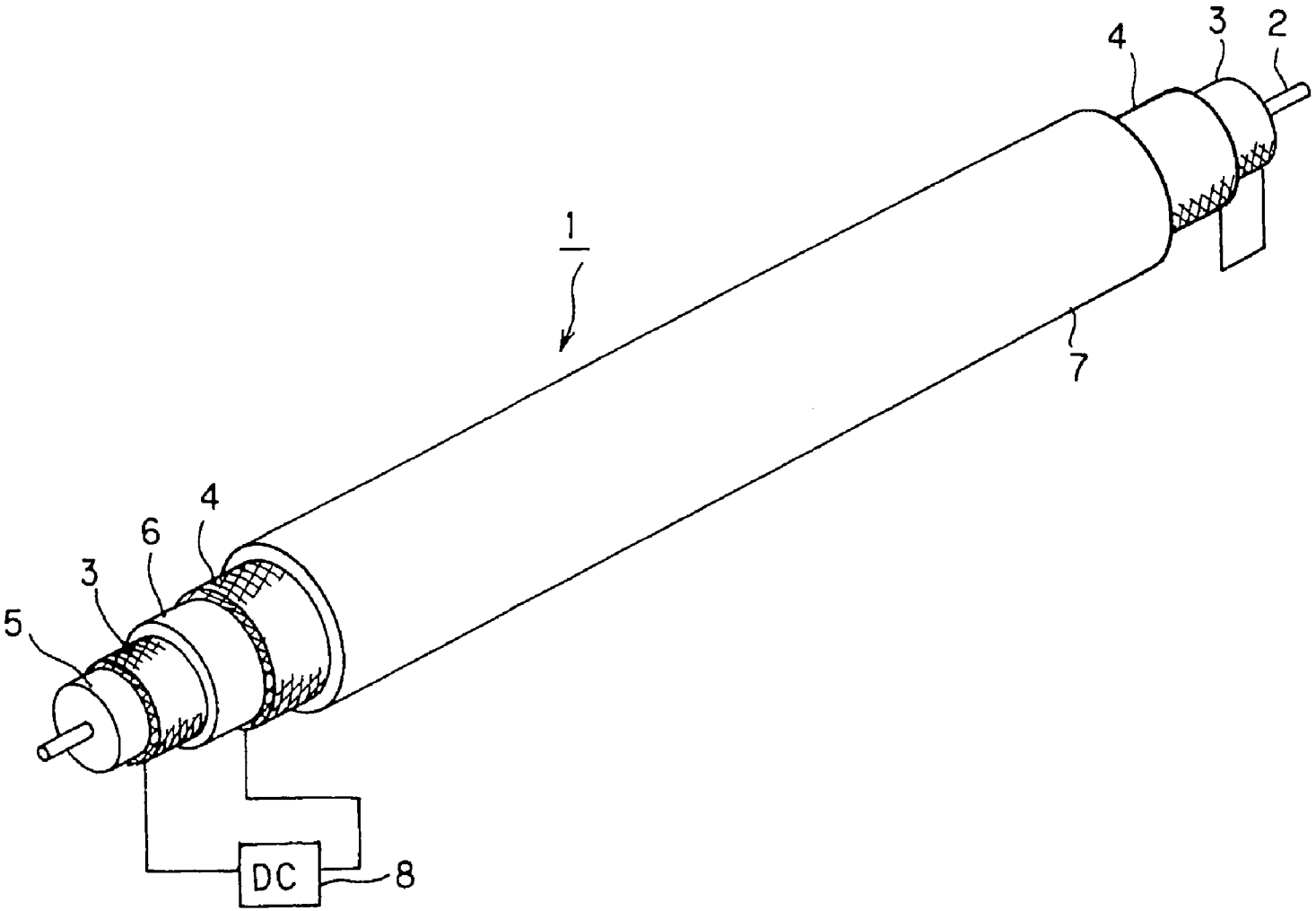
FIG. 1 is a schematic view of a coaxial cable according to an embodiment of the present invention.

FIG. 1 is a schematic view of a coaxial cable according to an embodiment of the present invention. In FIG. 1, 1 denotes a coaxial cable, 2 denotes a central conductor for transmitting signals, for example, of images, 3 denotes a first conductor on an outer circumference and arranged to be concentric with respect to the central conductor 2, 4 denotes a second conductor positioned on a circumference concentric to the central conductor 2 and outside the first conductor 3, 5 denotes a first insulator composed of, for example, polyvinyl chloride (PVC) on the outer circumference of the central conductor 2, 6 denotes a second insulator composed of, for example, polyvinyl chloride (PVC) provided between the first conductor 3 and the second conductor 4, 7 denotes a third insulator composed of, for example, polyvinyl chloride (PVC) provided outside the second conductor 4, and 8 denotes a DC voltage source for applying DC voltage having a predetermined voltage value between the first conductor 3 and the second conductor 4 such that direct current having a desired current value flows in the first conductor 3 and the second conductor 4. The DC voltage source 8 which causes direct current having a desired current value to flow in the first conductor 3 and the second conductor 4 is connected to one end of the first conductor 3 and the second conductor 4, and the other end of the first conductor 3 and the second conductor 4 are short-circuited.

Figure 2:
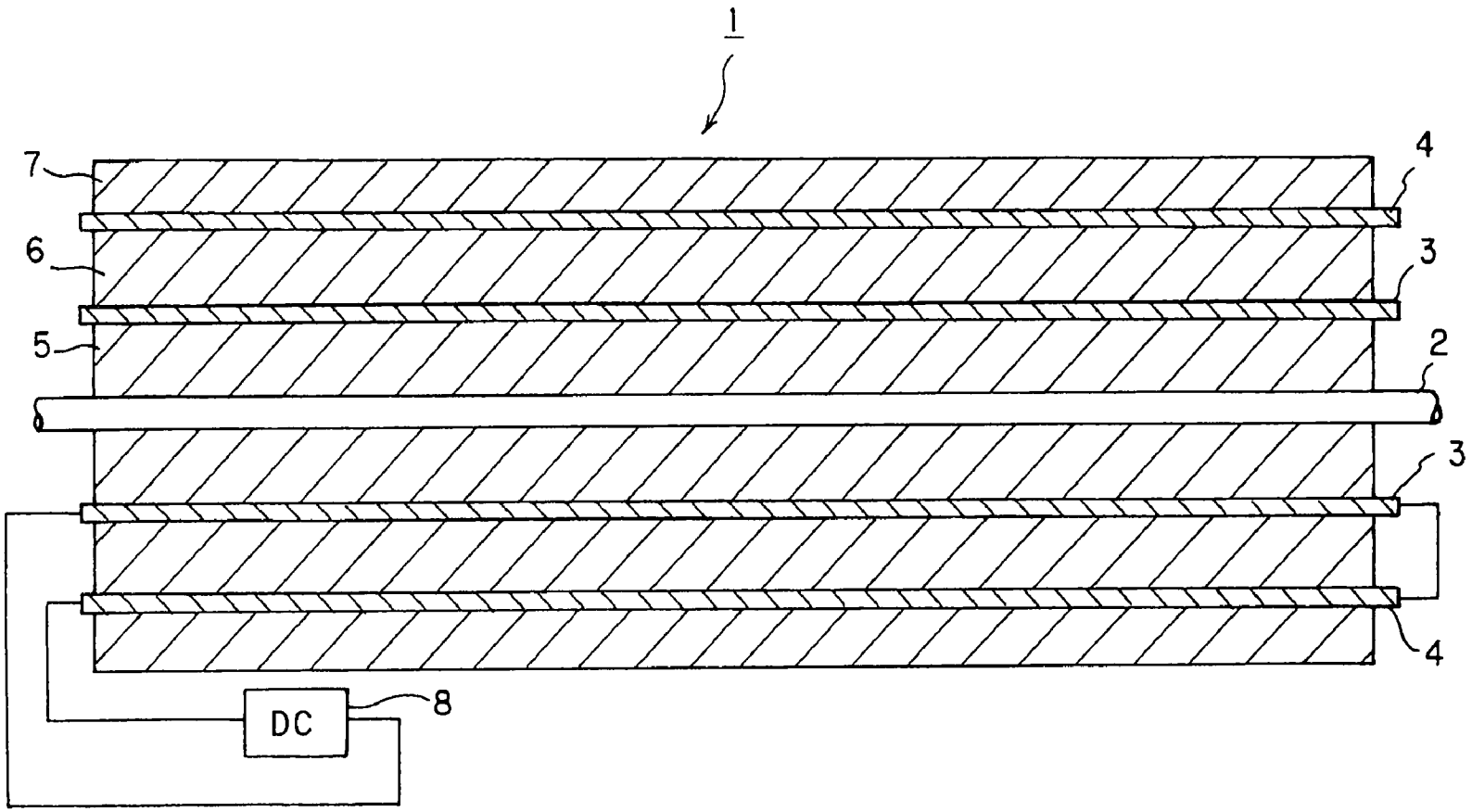
FIG. 2 is a sectional view of a coaxial cable according to the embodiment of the present invention.

FIG. 2 is a sectional view of the coaxial cable according to the embodiment of the present invention. In FIG. 2, the numbers which are the same as those in FIG. 1 are denoted by the same reference numerals and explanations thereof are omitted. As shown in FIG. 2, one end of the first conductor 3 and second conductor 4 are connected to the DC voltage source 8, the other end of the first conductor 3 and the second conductor 4 are short-circuited thereby forming a DC closed circuit comprising the DC voltage source 8, the first conductor 3, and the second conductor 4. In the DC closed circuit, a constant direct current which is determined by the predetermined voltage value of the DC voltage source 8 and the value of the resistance components of the first conductor 3 and the second conductor 4 flows.

Figure 3:
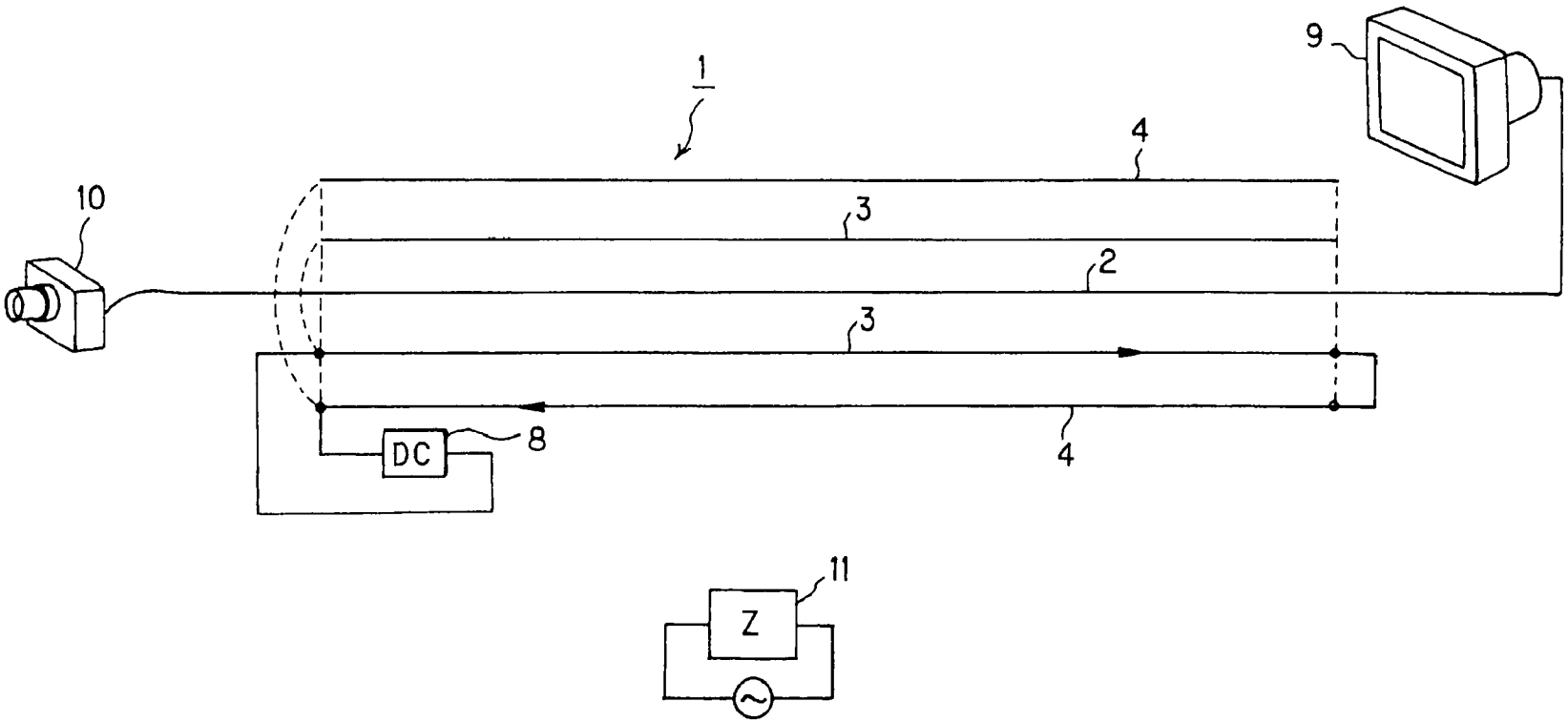
FIG. 3 is a diagram showing an example of a simple experiment for confirming the external noise shielding effects of the embodiment of the present invention.

FIG. 3 is a diagram showing an example of a simple experiment for confirming the external noise shielding effect of the embodiment of the present invention. The reference numerals which are the same as those in FIG. 1 denote the same numbers, therefore explanations thereof are omitted. In FIG. 3, 9 denotes a television receiver, 10 denotes a television camera, and 11 denotes a pulse noise generator. When the central conductor 2 is connected to a noise measurement circuit, the television receiver 9 may be a noise level detector. Herein, illustrations of the first insulator on the outer circumference of the central conductor 2, the second insulator provided between the first conductor 3 and the second conductor 4, and the third insulator outside the second conductor 4 are omitted.

As shown in FIG. 3, a constant desired current brought about by the predetermined DC voltage value flows in the closed circuit which is composed of the first conductor 3, the second conductor 4, and the DC voltage source 8. The current flowing through the first conductor 3 and the current flowing through the second conductor 4 have the same current value, and directions thereof are opposite to each other. The magnetic field caused by the current flowing in the first conductor 3 and the magnetic field caused by the current flowing in the second conductor 4 have the same magnetic field strength. In regard to the magnetic field direction, the magnetic field of the first conductor 3 is orthogonal to the longitudinal direction of the first conductor 3 and derived radially from everywhere along the first conductor 3. The magnetic field of the second conductor 4 is orthogonal to the longitudinal direction of the second conductor 4 and derived radially from everywhere along the second conductor 4. In the part surrounded by the first conductor 3 and the second conductor 4, the magnetic fields have directions opposite to each other. Therefore, in the part surrounded by the first conductor 3 and the second conductor 4, the magnetic fields cancel each other out and the magnetic field is seemingly zero. However, in a strict sense, it is conceived that the magnetic fields having directions opposite to each other are constantly generated from the first conductor 3 and the second conductor 4, and at the same time, they cancel each other out. Therefore, even though the magnetic field of the part surrounded by the first conductor 3 and the second conductor 4 is seemingly zero, an extremely active field in which magnetic fields constantly cancel each other out is generated.

Generally, when images are transmitted, cable compensators have to be provided about every 100 m in order to compensate for the attenuation of the picture signals. Therefore, if the cable compensator is not employed and only the coaxial cable of the invention of the present application is employed, obvious effects will be confirmed when clear images are transmitted to the television receiver which is at least 400 m away or when the noise coercively generated by the pulse noise generator does not influence the picture signals and the increase of the noise level of the noise level detector, and the noise level decreases in the cable of the present application relative to conventional coaxial cables.

In the experiment, first, for example, the aimed distance for transmitting images via a coaxial cable is determined and the overall length of the coaxial cable is determined. In a case of this experiment, the overall length of the cable is 400 m. The variable DC voltage source 8, the first conductor, and the second conductor of the coaxial cable are connected in series so as to form a closed circuit. Next, the picture signals of the television camera 10 are transmitted to the television receiver via the coaxial cable while noise is generated from the pulse noise generator 11. A variation is made by the DC voltage source 8 such that the DC value flowing in the closed circuit of the series connection of the variable DC voltage source 8, and the first conductor and the second conductor of the coaxial cable is varied. By varying the voltage value of the DC voltage source 8, the DC value in the closed circuit is varied and a desired current value can be sought and determined. In this state, the voltage condition in which no attenuation or disturbance of the image of the television receiver is shown or an optimal state having the lowest noise level is exhibited, is sought while the image of the television receiver is checked with eyes or the noise level is measured by the noise level detector.

The DC value in the closed circuit is determined depending on the resistance components in the closed circuit. Therefore, to be precise, the DC power supply voltage value required to flow the desired current value differs depending on the value of resistance components in every closed circuit. The resistance component based on the distance affects, in the highest ratio, the determination of a current value in the coaxial cable. Then, the approximate power supply voltage value that allows a desired current value to flow was confirmed by experiments sought in the distance of 400 m. The DC voltage value falls within about 12 V to about 120 V. Therefore, it was discovered that in order to provide the power supply voltage value for obtaining and flowing direct current having a desired value, a DC power supply which is able to provide DC power supply voltage value in the range 10 V to 30 V, preferably 10 V to 150 V, should be prepared.

When applied to a general 3C-5V coaxial cable of 6 Ω (ohms), the reached distance of the transmitted clear image exhibiting no disturbance or attenuation caused by noise was 500 m. In a coaxial cable of 4 Ω (ohms), the distance of the transmitted clear image exhibiting no disturbance or attenuation caused by noise was 450 m. Therefore, generally in coaxial cables, at least in the distance of 400 m, there exhibited effects in which any external noise including the influence of, for example, high frequency noises having steep wave forms generated when an accelerator of an electric system of an engine, for example, of a motorcycle is suddenly stomped on, are shut off (blocked). Therefore, regarding the transmission via a coaxial cable of clear images exhibiting no disturbance or attenuation caused by noises, the goal of reaching the distance of 400 m without employing cable compensators is accomplished.

According to a coaxial cable of the present invention, clear images are transmitted at least over the distance of 400 m without providing cable compensators, because a DC voltage source which is able to apply DC voltage having a predetermined voltage value between a first conductor and a second conductor such that the direct current flowing in the first conductor and the second conductor takes a desired value is provided.

Figure 4:
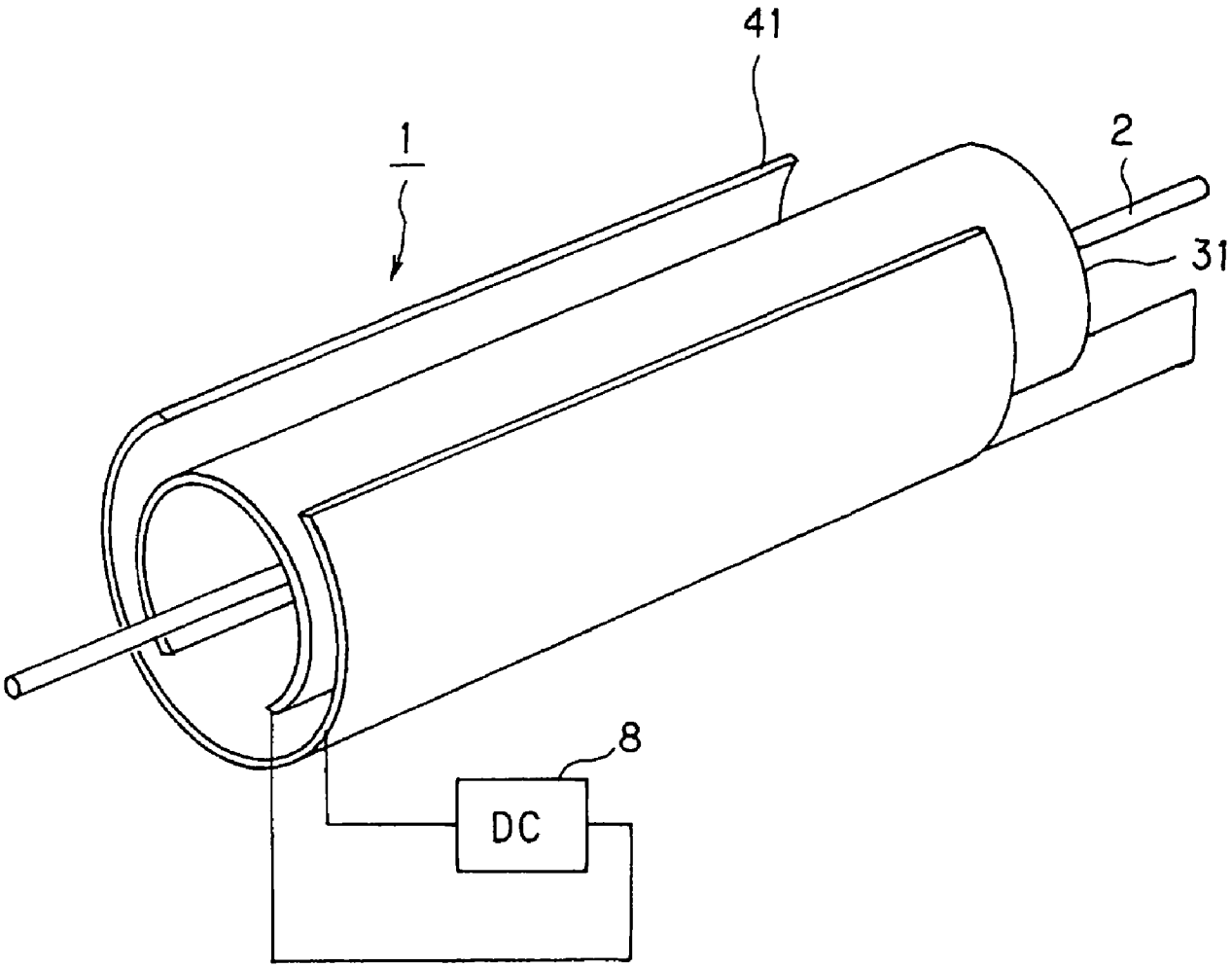
FIG. 4 is a schematic view of a coaxial cable according to a second embodiment of the present invention.

FIG. 4 is a schematic view of a coaxial cable according to a second embodiment of the present invention. In FIG. 4, the numbers which are the same as those in FIG. 1 are denoted by the same reference numerals, and explanations thereof are omitted. As shown in FIG. 4, 31 denotes a first conductor on an outer circumference concentric with respect to the central conductor 2, 41 denotes a second conductor positioned on an outer circumference concentric to the central conductor 2 and outside the first conductor 31, and 8 denotes a DC voltage source which applies a predetermined DC voltage between the first conductor 31 and the second conductor 41 in order to cause direct current having a desired current value to flow through the first conductor 31 and the second conductor 41. The first conductor 31 and the second conductor 41 each consist of a metal plate cylindrically wound up. As shown in FIG. 4, the ends of each cylindrically-shaped plate do not necessarily touch, so that there is a gap between the longitudinal ends of each plate. In other words, the metal plate of each conductor is incompletely wrapped around the central conductor. The illustrations of a first insulator on the outer circumference of the central conductor 2, a second insulator provided between the first conductor 31 and the second conductor 42, and a third insulator outside the second insulator 42 are omitted.

An experiment the same as the above-described experiment was carried out while employing the coaxial cable according to the second embodiment. As a result, the same effects were obtained under the desired current value of the present embodiment.

Figure 5:
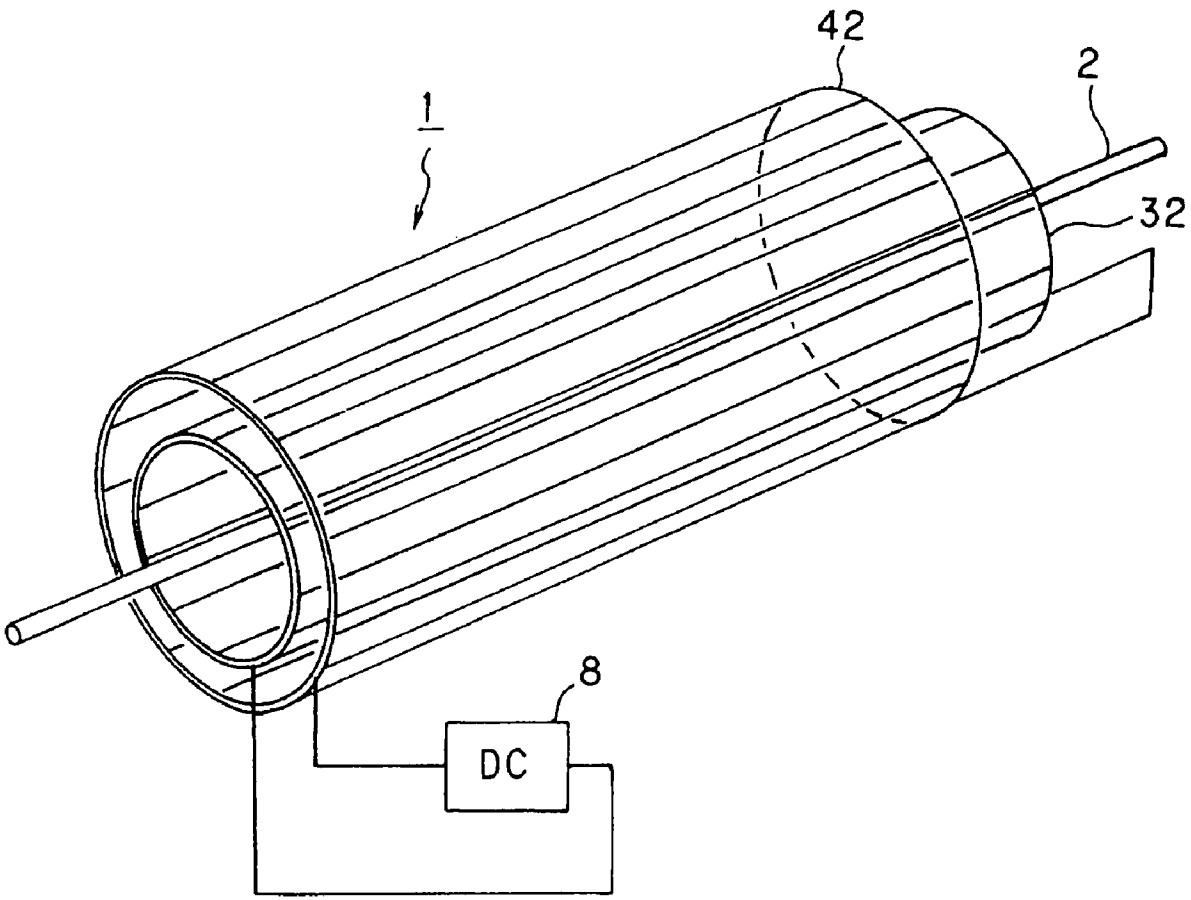
FIG. 5 is a schematic view of a coaxial cable according to a third embodiment of the present invention.

FIG. 5 is a schematic view of a coaxial cable according to a third embodiment of the present invention. In FIG. 5, the numbers which are the same as those in FIG. 1 are denoted by the same reference numerals, and explanations thereof are omitted. As shown in FIG. 5, 32 denotes a first conductor arranged on a circumference concentric to a central conductor 2, 42 denotes a second conductor positioned on an outer circumference concentric with respect to the central conductor 2 and outside the first conductor 31, and 8 denotes a DC voltage source which applies a predetermined DC voltage between the first conductors 32 and the second conductors 42 in order to cause direct current having a desired current value to flow in the first conductors 32 and the second conductors 42. As shown in FIG. 5, the first conductor 32 and the second conductor 42 each consist of a plurality of parallel elongated metal conductor elements electrically connected at both sides. The elongated conductor elements are arranged side-by-side as also shown in FIG. 5. The illustrations of a first insulator on the outer circumference of the central conductor 2, a second insulator provided between the first conductors 32 and the second conductors 42, and a third insulator outside the second conductors 42 are omitted.

An experiment the same as the above-described experiment was carried out while employing the coaxial cable according to the third embodiment. As a result, the same results were obtained under the desired current value of the third embodiment.

Figure 6:
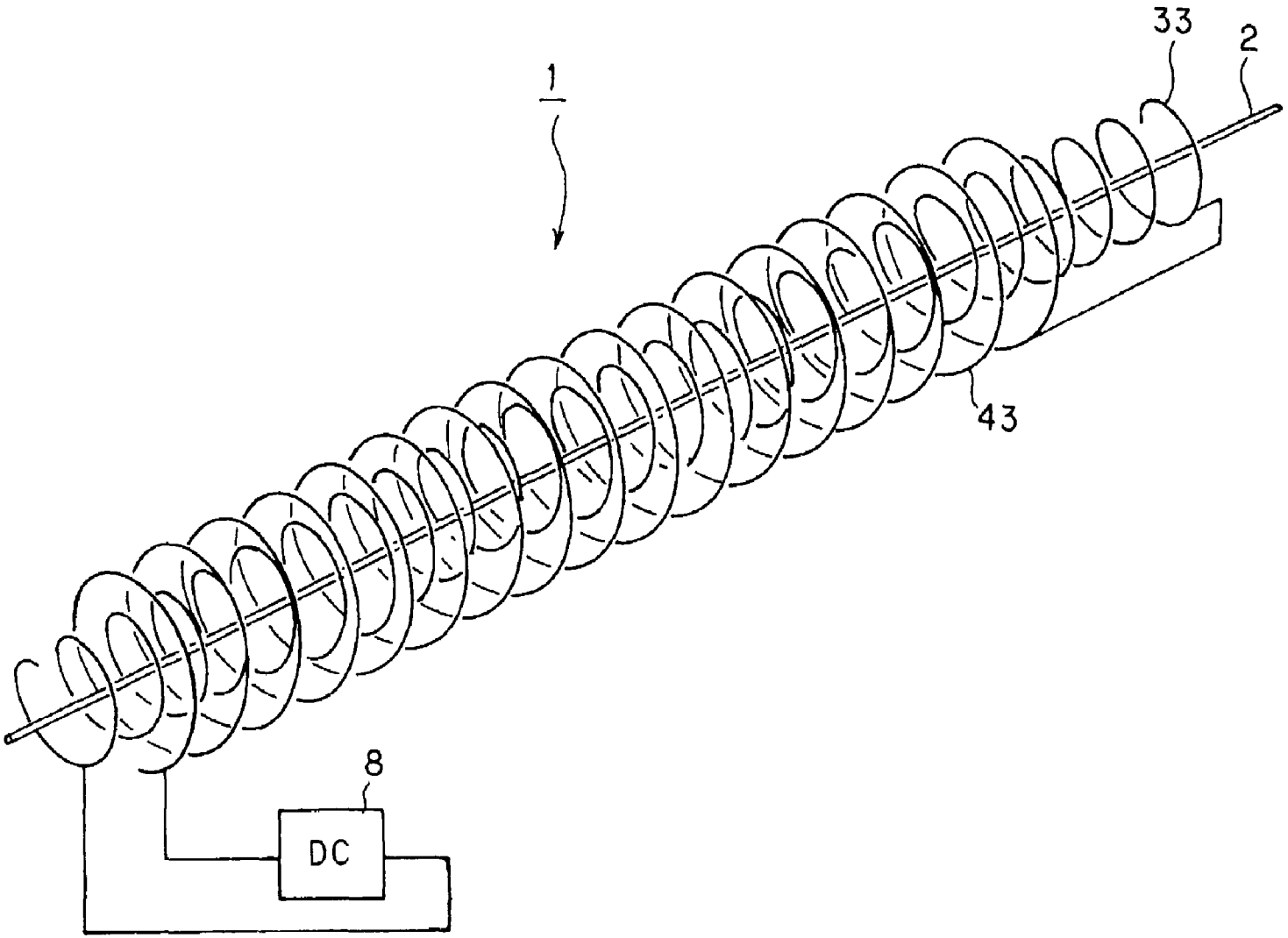
FIG. 6 is a schematic view of a coaxial cable according to a fourth embodiment of the present invention.

FIG. 6 is a schematic view of a coaxial cable according to a fourth embodiment of the present invention. In FIG. 6, the numbers which are the same as those in FIG. 1 are denoted by the same reference numerals and explanations thereof are omitted. A first conductor which is wound around an outer circumference so as to be concentric with respect to a central conductor 2 is denoted by 33, 43 denotes a second conductor wound around the outer circumference so as to be concentric with respect to the central conductor 2 and outside the first conductor 33, and 8 denotes a DC voltage source which applies DC voltage between the first conductor 33 and the second conductor 43 in order to cause direct current having a desired current value to flow in the first conductor 33 and the second conductor 43. The first conductor 33 and the second conductor 43 consist of metal conductors wound spirally around the central conductor 2. The illustrations of a first insulator on the outer circumference of the central conductor 2, a second insulator provided between the first conductor 33 and the second conductor 43, and a third insulator outside the second conductor 43 are omitted.

An experiment the same as the above-described experiment was carried out while employing the coaxial cable according to the fourth embodiment. As a result, same effects were obtained under a desired current value of the fourth embodiment.

Figure 7:
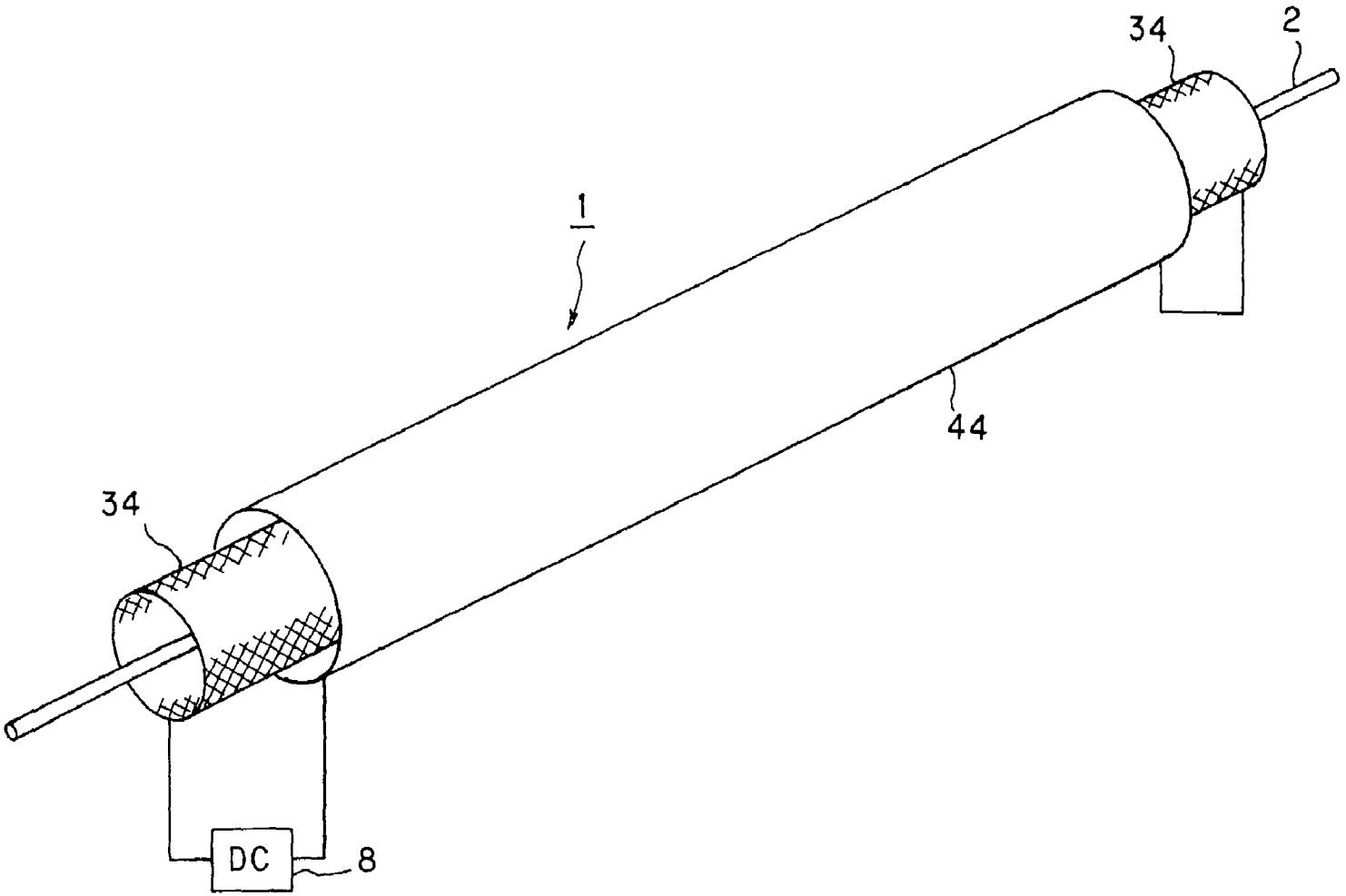
FIG. 7 is a schematic view of a coaxial cable according to a fifth embodiment of the present invention.

FIG. 7 is a schematic view of a coaxial cable according to a fifth embodiment of the present invention. In FIG. 7, the numbers which are the same as those in FIG. 1 are denoted by the same reference numerals and explanations thereof are omitted. As shown in FIG. 7, 34 denotes a braided first conductor outside the central conductor 2, 44 denotes a second conductor positioned on an outer circumference so as to be concentric with respect to the first conductor 2 and outside the braided first conductor 34, and 8 denotes a DC voltage source which applies a predetermined DC voltage between the braided first conductor 34 and the second conductor 44 in order to cause direct current having a desired current value to flow in the braided first conductor 34 and the second conductor 44. The illustrations of a first insulator on the outer circumference of the central conductor 2, a second insulator provided between the braided first conductor 34 and the second conductor 44, and a third conductor outside the second conductor 44 are omitted.

An experiment the same as the above-described experiment was carried out while employing the coaxial cable according to the fifth embodiment. As a result, same results are obtained under a desired current value of the fifth embodiment.

What is claimed is:

1. A coaxial cable comprising:

a central conductor;

a first conductor comprising a plurality of elongated and parallel first conductor elements arranged side-by-side so as to surround said central conductor, said first conductor elements being electrically interconnected;

a first insulator between said first conductor and said central conductor;

a second conductor comprising a plurality of elongated and parallel second conductor elements arranged side-by-side so as to surround said first conductor, said second conductor elements being electrically interconnected, said first conductor and said second conductor being arranged concentrically with respect to said central conductor;

a second insulator between said first conductor and said second conductor;

an insulating external coating over an outside of said second conductor; and a DC voltage source operable to apply DC voltage between said first conductor and said second conductor.

2. The coaxial cable of claim 1, wherein said DC voltage source is connected to a first axial end of each of said first conductor and said second conductor, and a second axial end of each of said first conductor and said second conductor are short-circuited together so as to form a closed circuit.

3. The coaxial cable of claim 1, wherein said DC voltage source is connected to said first conductor and said second conductor such that said first conductor side has positive voltage and said second conductor side has negative voltage or said first conductor side has negative voltage and said second conductor side has positive voltage; and such that a direct current having a desired current value flows through both said first conductor and said second conductor.

4. The coaxial cable of claim 1, wherein said DC voltage power supply is connected to said first conductor and said second conductor, and is operable to supply voltage within a range of 10 V to 150 V so as to form a noise barrier zone in an area surrounded by said first conductor due to electromagnetic action.

5. A coaxial cable comprising:

a central conductor;

only two conductors including a first single-layer conductor and a second single-layer conductor;

said first conductor being wrapped around said central conductor;

a first insulator between said first conductor and said central conductor;

only one of said first conductor and said second conductor comprising a braided conductor, said first conductor and said second conductor being arranged concentrically with respect to said central conductor;

a second insulator between said first conductor and said second conductor;

an insulating external coating over an outside of said second conductor; and a DC voltage source operable to apply DC voltage between said first conductor and said second conductor.

6. The coaxial cable of claim 5, wherein said DC voltage source is connected to a first axial end of each of said first conductor and said second conductor, and a second axial end of each of said first conductor and said second conductor are short-circuited together so as to form a closed circuit.

7. The coaxial cable of claim 5, wherein said DC voltage source is connected to said first conductor and said second conductor such that said first conductor side has positive voltage and said second conductor side has negative voltage or said first conductor side has negative voltage and said second conductor side has positive voltage; and such that a direct current having a desired current value flows through both said first conductor and said second conductor.

8. The coaxial cable of claim 5, wherein said DC voltage power supply is connected to said first conductor and said second conductor, and is operable to supply voltage within a range of 10 V to 150 V so as to form a noise barrier zone in an area surrounded by said first conductor due to electromagnetic action.

* * * * *